United States Patent [19]

Smith

[11] 4,277,194

[45] Jul. 7, 1981

[54] PASTE DISPENSING TOOTHBRUSH

[76] Inventor: Donald R. Smith, 1601 W. Knoxville, Broken Arrow, Okla. 74012

[21] Appl. No.: 77,342

[22] Filed: Sep. 20, 1979

[51] Int. Cl.[3] ..... B46B 11/02

[52] U.S. Cl. ..... 401/173; 222/326; 222/390; 401/182

[58] Field of Search ..... 401/173, 174, 177, 179, 401/182; 222/326, 386, 390

[56] References Cited

U.S. PATENT DOCUMENTS

| | | | |
|---|---|---|---|
| 499,612 | 6/1893 | Tower | 401/174 |
| 1,362,937 | 12/1920 | Grace | 401/174 |
| 1,498,439 | 6/1924 | Flom | 222/390 |
| 1,968,686 | 7/1934 | Janer | 401/173 |
| 2,018,158 | 10/1935 | Violette | 401/174 |
| 2,167,815 | 8/1939 | Rosler | 401/174 |
| 2,199,877 | 5/1940 | Cervera | 401/174 |
| 2,498,384 | 2/1950 | Wikheim | 401/182 |
| 3,378,176 | 4/1968 | Snyder | 401/182 |
| 3,995,648 | 12/1976 | Kuryla | 401/173 |
| 4,083,477 | 4/1978 | Zetterberg | 222/386 |

FOREIGN PATENT DOCUMENTS

| | | | |
|---|---|---|---|
| 579198 | 10/1924 | France | 401/174 |
| 725495 | 2/1932 | France | 401/174 |
| 627739 | 8/1949 | United Kingdom | 401/174 |

*Primary Examiner*—Clyde I. Coughenour
*Attorney, Agent, or Firm*—James H. Chafin

[57] ABSTRACT

A toothbrush having a polishing paste compartment and a plunger apparatus for forcing paste through a passageway into communication with the bristles of the toothbrush. The compartment for containing the paste may be either a refillable container or cartridge or a disposable cartridge. The plunger is operated by a thumb wheel drive located at the end of the toothbrush handle.

5 Claims, 4 Drawing Figures

PASTE DISPENSING TOOTHBRUSH

BACKGROUND OF THE INVENTION

1. Field of the Invention

The present invention relates to toothbrush mechanisms and more particularly, but not by way of limitation, to a toothbrush having a compartment for containing paste and a drive apparatus for selectively forcing the paste into communication with the bristles.

2. History of the Prior Art

Many attempts have been made to provide a toothbrush which carries its supply of toothpaste in the handle or in a compartment associated with the toothbrush for obvious reasons, not the least of which is portability for travelling or daily teeth brushing at the office or at school.

Another pressing problem is that of inducing children to brush regularly in an attempt to keep their teeth relatively clean between dental office visits.

Further, it is simply unhandy to carry a toothbrush and to have to separately carry a tube of toothpaste, the result of which is very few people brush after every meal, especially after the noontime meal which is usually away from home.

Several of the devices previously attempted were complicated in construction and included pressurized compartments with valves, pumps and flexible bags which required squeezing to force out the paste. Often paste would harden in the orifice between usages and the force available was not sufficient to expel the hardened portion of the paste for the next usage.

Another problem present with the prior art was that due to complexity of construction and operation, such devices were too expensive to get on the market and were practically impossible to clean between usages.

However, one of the prior art devices did teach a more positive method of driving out paste out of the container. That teaching is found in FIGS. 1 through 5 of the patent to Joseph A. Velardi, U.S. Pat. No. 3,868,188, issued Feb. 25, 1975 for a "Brush with Material Supply".

The Velardi device included a rather large cartridge which not only contained a large supply of dentrifice paste, but also contained a rotatable drive rod which caused a disc to follow helical tracks built into the inside surface of the cartridge, the disc serving to force toothpaste out of the opposite end of the cartridge. The problem with the Velardi device is that the cartridge is simply too expensive to manufacture as a throw-away paste supply since the drive components are totally located within the cartridge. On the other hand, the fixed brush components of the Velardi device would be relatively inexpensive. Further, the cartridge serves as a handle for the Velardi toothbrush and therefore must be rigidly constructed which again adds to the cost.

SUMMARY OF THE INVENTION

The present invention provides a paste dispensing toothbrush utilizing a cartridge which is simple and economical to construct and wherein the toothbrush handle and brush components contain and carry the more expensive drive elements. Further, the handle member is provided with the rigidity needed to be used in an ordinary manner.

The brush element of the present invention is similar to the end of an ordinary toothbrush but having a longitudinal passageway through the shank portion and a plurality of ports in communication with the bristles. The end of the shank is provided with threads or other suitable means to attach the handle member thereto.

The handle member is an elongated hollow cylindrical member open at each end. About half of the interior of the handle adjacent to the end that attaches to the shank, serves as a compartment for receiving and holding a disposable paste containing cartridge.

The second half of the handle serves as a drive compartment and is internally threaded. The outer end of the drive compartment is provided with a rotary thumb-finger operated drive knob which closes off the outer end of the handle. An elongated drive rod having a polygonal cross-sectional shape and having a length of approximately one-half that of the handle, is secured at one end of the rotary drive knob and extends into the drive compartment.

A drive disc having the outer periphery threaded is threadably disposed within the drive compartment. The drive disc is provided with a center aperture of polygonal cross-sectional shape for slidably receiving the drive rod therethrough while insuring rotation thereof with rotation of the drive rod.

The cartridge comprises a cylindrical tube section having a nozzle at one end, the other end being provided with a piston member slidably disposed therein whereby the tooth polishing paste is contained between the piston and the nozzle end. An elongated hollow piston rod is attached to the piston and extends outwardly from the cartridge for receiving the rotary drive rod therein, the outer end of the piston rod being engageable with the drive disc.

Therefore, it is seen that the piston and piston rod may be made of a single part, and the cartridge body as another single part which are simple and economical to construct.

The toothbrush and handle are also relatively simple to construct with the required rigidity for normal operation of the toothbrush. Cleaning is easy to accomplish since the only components to come into contact with the paste are the bristles and the passageway within the shank which carries the bristles.

The cartridge may be pre-loaded with an amount of paste for one or multiple brushings. For example, the cartridge may be equipped to carry enough toothpaste so that one cartridge would be usable for the duration of a short trip.

The positive drive action of the present invention assures the ability to force the desired amount of paste into contact with the bristles regardless of some inconsistency in the flowability of the paste.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENT

Figure 1:
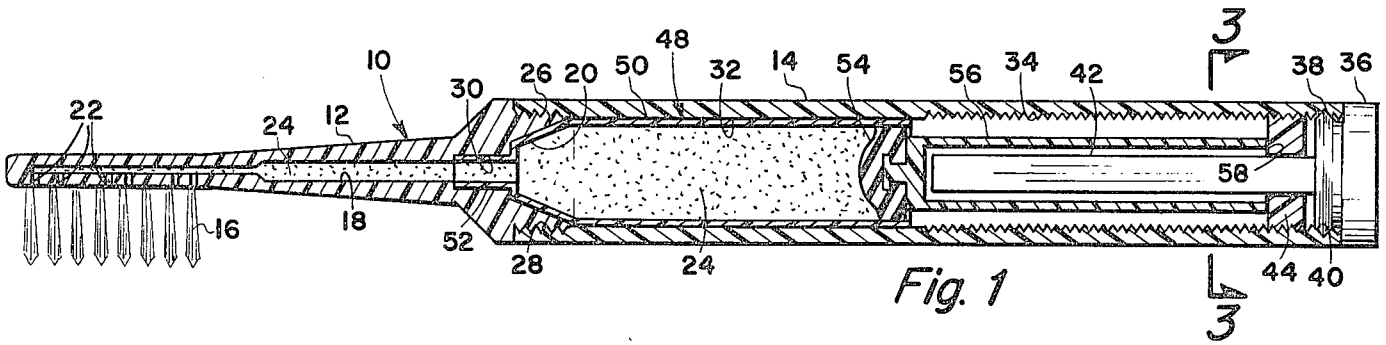
FIG. 1 is an elevational sectional view of a toothbrush embodying the present invention.

Referring to the drawings in detail, reference character 10 generally indicates a paste dispensing toothbrush comprising an elongated shank member 12 and an elongated hollow cylindrical handle member 14.

The shank member 12 is provided with a plurality of bristles 16 near one end thereof and is also provided with an elongated longitudinal passageway 18 extending from an open end 20 of the shank member to and into communication with a plurality of ports 22 provided at the base of the bristles 16.

Tooth cleaning and polishing paste material indicated by reference character 24 may be forced along the passageway 18, through the ports 22 and into communication with the bristles 16 as will be hereafter set forth. The outer periphery of the end of the shank member is provided with a plurality of threads 26 for threadably receiving one end of the handle member 14 which is also provided with matching threads 28. The open end 20 of the shank member 12 is provided with a centrally disposed recess 30 surrounding the end of the passageway 18.

The handle member 14 is provided with an elongated paste compartment 32 which typically extends through approximately one-half of the length of the handle and is in open communication with the shank passageway 18 when the handle 14 is attached to the shank member 12.

Figure 3:
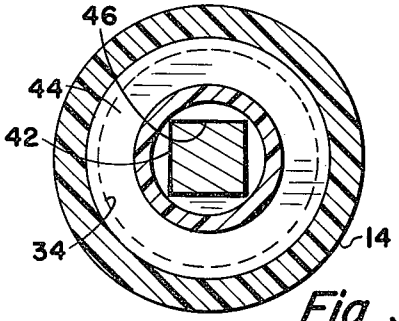
FIG. 3 is an end sectional view of the toothbrush of FIG. 1 taken along the broken lines 3—3 of FIG. 1.

The outer end portion of the handle member 14 is provided with internal helical threads 32 which extend from the outer end of the paste compartment 32 to the outer end of the handle member. A rotary drive knob 36 is rotatably secured to the outer end of the handle member by means of a flange member 38 carried by the drive knob 36 and an annular groove 40 provided on the inside wall of the handle member adjacent the end thereof. An elongated drive rod 42 has one end thereof secured to the drive knob 36, extends into the threaded drive compartment 34 and terminates adjacent the paste containing compartment 32. The cross-sectional shape of the drive rod 42 is shown as being square in FIG. 3 but may take on any polygonal shape or any other suitable shape to serve as a wrenching element for a purpose that will be hereinafter set forth.

A drive disc 44 is threaded around the outer periphery thereof and is threadably disposed within threaded drive compartment 34. The disc 44 is provided with a polygonal shaped aperture 46 for slidably receiving the drive rod 42 therethrough. The shape of the drive rod 42 and the cooperating shape of the aperture 46 of the disc serve to allow the disc 44 to slide along the rod 42 but to rotate therewith. Hence, it can be seen that rotation of the knob 36 and associated drive rod 42 causes the disc 44 to be threadably moved along the drive compartment 34 in a direction determined by the direction of rotation of the knob 36.

Figure 2:
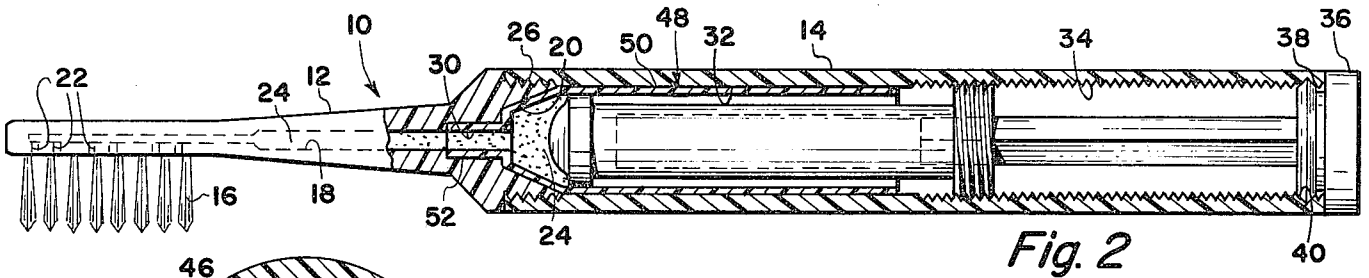
FIG. 2 is an elevational view, partially in section, of the toothbrush of FIG. 1 with the piston in a second position.

A toothpaste carrying cartridge member generally indicated by reference member 48 is carryable within the paste compartment 32 of the handle 14 as shown in FIGS. 1 and 2. The cartridge 48 generally comprises a cylindrical body portion 50 which is necked down to form a nozzle 52 at one end thereof and which is receivable within the open end 20 and recess 30 of the shank member 12.

A plunger or piston member 54 is slidably carried within the body portion 50 of the cartridge whereby the paste material 24 is carried between the piston member and the nozzle 52. An elongated hollow piston rod 56 is secured to the piston 54 and extends outwardly from the cartridge body 50 for loosely receiving the drive rod 42 therein. The outer end 58 of the piston rod is engagable with the drive disc 44.

It is noted that the cartridge member 48 may be a disposable cartridge that is marketed as a pre-loaded toothpaste carrying cartridge for use with the toothbrush described herein. It is further noted at this point that the relative dimensions of the paste compartment 32 may be varied from the size shown in the drawings, taking up approximately half of the inner end of the toothbrush handle down to a smaller size if it is desired to provide a smaller amount of paste within the cartridge. The internally threaded drive compartment 34 simply needs to extend far enough into the handle member so that the paste may be substantially completely dispensed into the shank passageway of the toothbrush.

It can be seen in operation that the shank member 12 and handle member 14 may be disengaged to dispose of a spent cartridge. After disposing of the spent cartridge, the knob 36 is rotated in a direction to move the drive disc 44 back up to a position adjacent the drive knob 36. The device is now ready to receive another cartridge 48 therein. A new cartridge 48, is then installed having its piston member 54 and associated piston rod 56 attached.

The drive knob 36 and drive rod 42 may then be rotated along with the drive disc 44. As the disc 44 rotates, it slidably moves along the rod 42 into contact with the outer end 58 of the piston rod 56. Further rotation of the drive knob 36 thereby pushes the piston rod 56 and associated piston member 54 through the cartridge body 50 thereby forcing paste out of the cartridge, through the passageway 18, through the ports 22 and into communication with the brushing elements or bristles 16.

It is noted that it is entirely up to the user as to how much paste is disposed by simply rotating the knob 36 until the desired amount of paste appears at or around the bristles 16.

After brushing, the user may simply unscrew the shank member 12 and completely wash the bristles and the passageway 18 and then resecure the shank member 12 to the handle 14 with the cartridge still intact. The brush is now ready for subsequent usage.

It is also noted that the entire device may serve as a cartridge whereby the entire toothbrush is a throw-away item and comes with the paste compartment 32 prefilled with paste 24. However, at this point it is felt that such usage would not be economically feasible.

Figure 4:
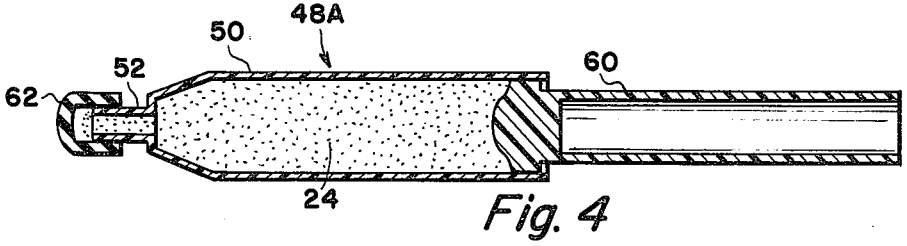
FIG. 4 is an elevational sectional view of the cartridge for use with the toothbrush of FIG. 1.

Referring now to FIG. 4, reference character 48A generally represents a second embodiment of the cartridge having an identical body portion 50 and associated nozzle member 52 which is pre-filled with paste 24.

In this case, the piston and piston rod are formed as one single piece indicated by reference character 60. A removable cap member 62 is placed over the open end of the nozzle 52. Upon use with the toothbrush hereinbefore described, the cap member 62 is simply removed from the nozzle and the cartridge then is inserted within the toothbrush handle and the shank member of the toothbrush as hereinbefore described.

From the foregoing it is apparent that the present invention provides a toothpaste dispensing toothbrush apparatus having a positive drive system carried within the handle member. The apparatus also provides a disposable cartridge member which is simple and efficient in construction and operation for use with a toothbrush hereinbefore described.

Whereas, the present invention has been described in relation to the drawings attached hereto, other and further modifications apart from those shown or suggested herein may be made within the spirit and scope of the invention.

What is claimed is:

1. A paste feed toothbrush comprising an elongated shank member having bristles and a passageway extending from one end of the shank member into open communication with the bristles, an elongated hollow cylindrical handle member having the first end securable to the shank member, a paste compartment in the handle member in communication with the shank passageway when the handle is secured to the shank, a piston member slidably carried in the paste compartment, an elongated hollow piston rod carried by the piston and extending toward the second end of the handle member, a drive knob member rotatably carried by the second end of the handle member, an elongated rotary drive rod secured to the drive knob and having a polygonal shaped cross-section and extending toward the first end of the handle, said rod being loosely receivable within the hollow piston rod, a rotary drive disc having a polygonal shaped aperture therein for slidably receiving the drive rod therethrough and for rotating with said drive rod, said drive disc being threadably disposed within the handle member and engageable with the outer end of the piston rod whereby upon rotation of the drive knob and associated drive rod, the drive disc threadably moves along the interior of the handle toward the first end thereof thereby pushing the piston through the paste compartment forcing the paste into communication with the bristles.

2. A paste feed toothbrush comprising an elongated shank member having bristles and a passageway extending from one end of the shank member into open communication with the bristles, an elongated hollow cylindrical handle member having a first end securable to the shank member, a paste compartment in the handle member in communication with the shank passageway when the handle is secured to the shank, a removable paste cartridge member removably disposed within the paste compartment in the handle member, said cartridge member having an open end in communication with the shank passageway, said cartridge further comprising a piston member slidably carried therein, an elongated hollow piston rod carried by the piston member and extending toward the second end of the handle member, a drive knob member rotatably carried by the second end of the handle, and an elongated rotary drive rod secured to the drive knob and having a cross-sectional shape providing a wrenching element and extending toward the first end of the handle member said rod being loosely receivable within the hollow piston rod, a rotary drive disc having an aperture which serves as a wrenching element recess for slidably receiving the drive rod therethrough and for rotating with said drive rod, said drive disc being threadably disposed in the handle member and engagable with the outer end of the piston rod whereby upon rotation of the drive knob and associated drive rod, the drive disc threadably moves along the interior of the handle toward the first end thereof thereby pushing the piston through the cartridge forcing paste into communication with the bristles.

3. A paste feed toothpaste as set forth in claim 2 wherein the piston rod is constructed as an integral part of the piston.

4. A paste feed toothbrush as set forth in claim 2 wherein one end of the cartridge is provided with a nozzle member, the exterior shape thereof being in conformity with the interior shape of the shank member.

5. A paste feed toothbrush as set forth in claim 2 wherein the shank member and first end of the handle member are cooperatively threaded for attaching the shank member to the handle member.

* * * * *